US006754909B1

(12) United States Patent
Samelian

(10) Patent No.: US 6,754,909 B1
(45) Date of Patent: Jun. 29, 2004

(54) NECK GATOR

(76) Inventor: John Samelian, 920 Rae Ct., Mendota Heights, MN (US) 55118

( * ) Notice: Subject to any disclaimer, the term of this patent is extended or adjusted under 35 U.S.C. 154(b) by 0 days.

(21) Appl. No.: 10/442,458

(22) Filed: May 21, 2003

(51) Int. Cl.[7] ..... A42B 1/18
(52) U.S. Cl. ..... 2/206
(58) Field of Search ..... 2/173, 206, 208, 2/209.11, 9, 468, DIG. 1, 201, 202, 203, 204, 205; 128/201.15, 201.23, 201.17, 201.24

(56) References Cited

U.S. PATENT DOCUMENTS

| | | | | | |
|---|---|---|---|---|---|
| 2,677,133 | A | * | 5/1954 | Hoffman | 2/206 |
| 3,134,984 | A | * | 6/1964 | Ward | 2/206 |
| 3,890,966 | A | * | 6/1975 | Aspelin et al. | 128/201.17 |
| 4,037,593 | A | * | 7/1977 | Tate, Jr. | 128/201.17 |
| 4,419,994 | A | * | 12/1983 | Hilton | 128/206.19 |
| 4,825,474 | A | | 5/1989 | Edwards | 2/206 |
| 5,025,507 | A | * | 6/1991 | Kirby | 2/206 |
| 5,035,006 | A | * | 7/1991 | Hetz et al. | 2/209.11 |
| 5,214,804 | A | | 6/1993 | Carey et al. | 2/206 |
| D369,442 | S | | 4/1996 | Jones | D29/108 |
| 5,551,087 | A | * | 9/1996 | Blutstein et al. | 2/173 |
| 5,628,065 | A | * | 5/1997 | Austin | 2/81 |
| 5,704,063 | A | * | 1/1998 | Tilden | 2/9 |
| 5,704,068 | A | | 1/1998 | Martin | 2/173 |
| 5,797,146 | A | * | 8/1998 | Matich | 2/424 |
| D398,136 | S | * | 9/1998 | Samelian | D2/600 |
| 5,822,800 | A | | 10/1998 | Anderson | 2/202 |
| 6,023,787 | A | * | 2/2000 | French et al. | 2/202 |
| 6,272,690 | B1 | | 8/2001 | Carey et al. | 2/206 |
| 6,336,459 | B1 | * | 1/2002 | Miyake et al. | 128/857 |
| 6,474,336 | B1 | * | 11/2002 | Wolfe | 128/206.21 |
| 6,520,181 | B2 | * | 2/2003 | Baumann et al. | 128/206.19 |
| 6,523,179 | B1 | * | 2/2003 | Zegarelli et al. | 2/9 |
| 6,532,598 | B1 | * | 3/2003 | Cardarelli | 2/173 |

OTHER PUBLICATIONS 2003 catalog # 5921 of Competition Accessories.com (p. 12).
Confidentiality agreements.

* cited by examiner

*Primary Examiner*—John J. Calvert
*Assistant Examiner*—Alissa L. Hoey
(74) *Attorney, Agent, or Firm*—Jacobson & Johnson

(57) ABSTRACT

A convertible headwear including a nose brim with the nose brim containing a wind-block material to prevent moisture laden air from being expelled therethrough with an unimpeded opening around the user's mouth and nostrils to permit a person to exhale a moisture laden breath away from the user's face to thereby avoid a feeling of clamminess and to inhibit the fogging of a user's eyeglasses should the user be wearing eyeglasses with the nose brim foldable to condition for blocking access through the headwear when the headwear is used in the neck gator mode.

19 Claims, 2 Drawing Sheets

NECK GATOR

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

FIELD OF THE INVENTION

This invention relates generally to clothing and, more specifically, to a convertible headwear article that in one mode permits a person to breath comfortably without a clammy feeling around the user's mouth as well as to inhibit fogging eyeglasses if the user is wearing eyeglasses and in another mode protects a user's neck from the environment

BACKGROUND OF THE INVENTION

The concept of head warmers or headwear and particularly neck gators that extend upward along at least a portion of a user's face are old in the art U.S. Design Pat. No. 369,442 shows a design for a combination mask and scarf where a series of holes are located in the mouth region.

My U.S. Design Pat. No. 398,136 shows a neck warmer where the nose shield extends downward over the mouth area.

U.S. Pat. No. 5,214,804 shows a protective mask with scarf having a nose opening and a series of small holes for the mouth area.

U.S. Pat. No. 4,825,474 shows a cold weather mask with a nose opening and a set of small holes for the mouth with the mask shaped to fit about the face.

U.S. Pat. No. 5,822,800 shows a hat that can be worn as a neck warmer.

U.S. Pat. No. 6,272,690 shows a head covering a with a nose opening and a set of small holes for the mouth with the mask shaped to fit about the face.

U.S. Pat. No. 5,704,068 shows a cowl to protect the head face and neck of a user with the cowl includes a channel that directs the exhaled air downward to reduce the likelihood of a user's glasses becoming fogged.

While there are a number of different types of headwear available, there are difficulties or drawbacks that limit the comfortable and effective use of the headwear in different modes. For example, most headwear is suitable for those people who do not wear eyeglasses; however, for those people who do wear eyeglasses they are subject to the annoying problem of having the eyeglasses fog up as the user exhales. This is a particularly annoying problem and can be hazardous if the person is operating equipment out-of-doors. The present invention provides headwear that can be comfortably worn by a person who does not wear eyeglasses or by a person who does wear eyeglasses. If the headwear is worn by a person wearing eyeglass the headwear inhibits the fogging of the user's eyeglasses as the user exhales. For those user's who do not wear eyeglasses and do not have the problem of eyeglasses fogging they usually report that the neck gator has a cold and clammy feeling as the moisture condenses in the portion of the neck gator that extends around the user's mouth and nose area. The present invention when in the face mask mode not only inhibits the fogging of a user's eyeglasses but also inhibits the clammy feeling associated with face masks or headwear that trap and retain moisture in the fabric, which is next to the user's face.

Other headwear that might be usable in the neck warmer mode suffers from the fact that the openings in the headwear to allow the headwear to function as a facemask make it uncomfortable to use as a neck warmer. In addition, if moisture is retained from the face mask mode wearing the mask in the neck warmer mode is uncomfortable. The present invention overcomes the problems by not only providing headgear that is effective in the facemask mode but headgear that can be quickly pulled down off the user's face to function in the neck gator mode as an effective neck warmer.

SUMMARY OF THE INVENTION

A convertible headwear or convertible headgear article having a face mask mode including a nose brim with the nose brim extending away from the users face with the nose brim containing a wind-block material to prevent moisture laden air from being expelled through the fabric of the nose brim with the neck gator having an unimpeded opening around the user's mouth and nostrils to permit a person to exhale a moisture laden breath though the neck gator and away from the user's face to thereby inhibit the fogging of a user's eyeglasses as well as inhibit the clammy feeling that occurs when a face mask becomes moisture laden when used in the face mask mode. When the headgear is used in the neck gator mode the convertible headwear protrusions collapse to provides effective protection to the user's neck by blocking wind access to the user's neck through air breathing openings in the headgear.

DESCRIPTION OF THE PREFERRED EMBODIMENT

Figure 1:
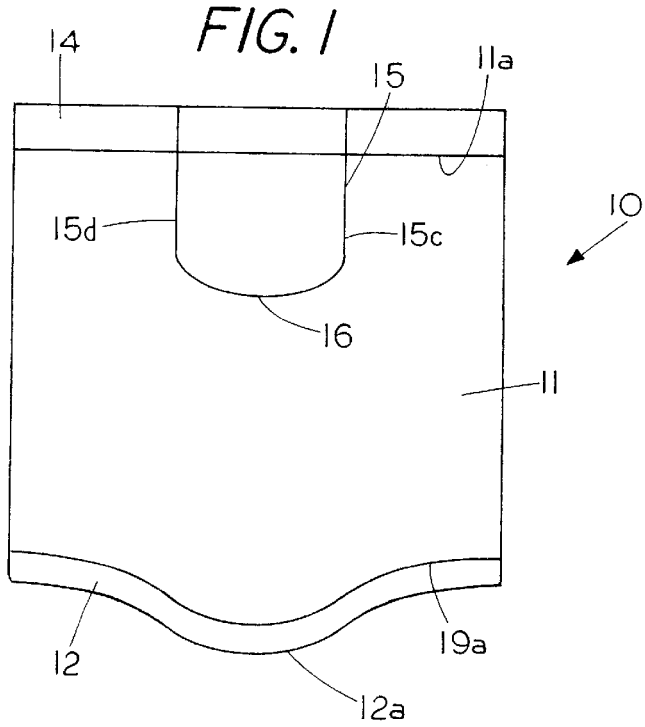
FIG. 1 is a front view of my headwear in a storage condition or shipping condition.
Figure 3:
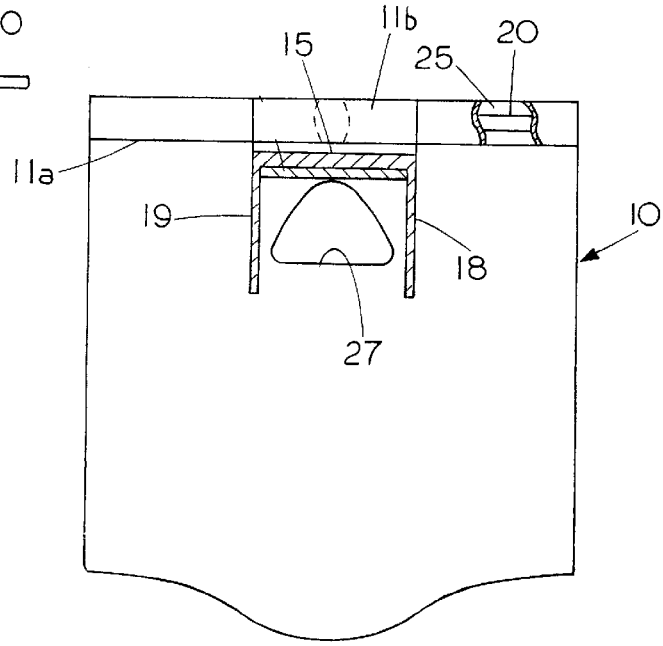
FIG. 3 is a partial cutaway view of the headwear of FIG. 1 revealing the nasal and oral passageway for exhaling air therethrough.

Referring to the drawings, FIGS. 1 and 3 show headwear 10 in the face mask mode for inhibiting fogging of a wearer's eyeglasses as well as inhibiting the clammy feeling of conventional face masks. The headwear 10 includes a stretchable cloth band 11 having a top folded over edge 14 and a bottom folded over edge 12. Top edge 14 comprises a folded edge of band 11 which is fastened to band 11 by stitching 11 a to form a circumferential channel 25 for a face securement member 20 such as a drawstring or the like for securing the top of gator 10 around a uses'face and above or on a user's nose. Headwear 10 includes a triangular shaped frontal opening 27 that is sufficiently large to extend around a user's nose and form a non-contacting relationship to either a user lips or a user's nostrils or both. The frontal opening 27 permits a user to unimpededly inhale and exhale through the mask without having to direct the inhaled and exhaled air through the pores of the fabric comprising the band 11 and thus avoiding an opportunity for moisture to condense in the material of band 11. With the frontal opening configured to extend laterally outward of both a users nasal passages and a user's lips one forms a vent or unimpeded passageway through the band 11 to enable an exhaled breadth, from either a user'snares or a user's mouth, to flow from the inside of band 11 to the outside of band 11 without moisture condensing therein thus avoiding the clammy feeling associated with masks that allow moisture to condense in the fabric of the face mask proximate the users mouth and nose.

Figure 2:
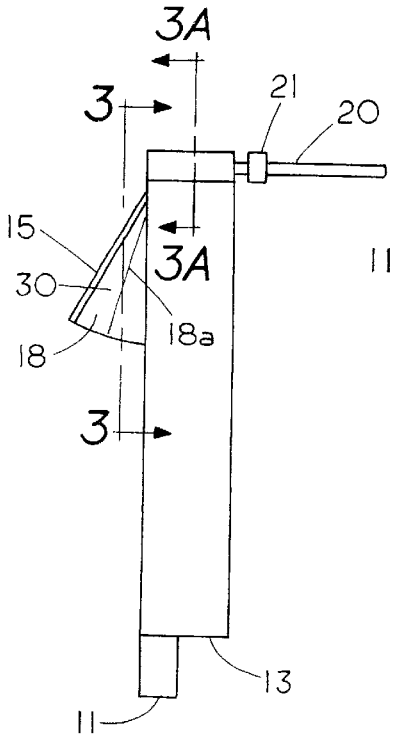
FIG. 2 is a side view of my headwear of FIG. 1 in the face mask mode with the nose brim in an extended condition.

FIG. 2 shows nose brim 15 in an extended condition. The extended condition corresponds to the condition when a user places the headwear 10 on the users face. The protrusion of the user's nose holds the nose brim 15 in the extended or angled condition as shown in FIG. 2. The nose brim 15 is secured to stretchable band 10 at a position above the frontal opening by stitching 11*a*. A first triangular shaped tapered pleat 18 extends along a first side of nose brim 18 with one side of the tapered pleat securing a first side 15*c* of nose brim 15 to the stretchable band 10 lateral of a first side of frontal opening 27 through stitching. Similarly, a second triangular shaped tapered pleat 19 extends along a second side 15*d* of nose brim 15 with one side of the second tapered pleat 19 securing the second side 15*d* of nose brim 15 to stretchable band 10 lateral of a second side of frontal opening 27 also through stitching. The lower edge 16 of nose brim 15 is free of any attachment to band 10.

The first tapered pleat 18 and the second tapered pleat 19 comprise a wind-block material that inhibits or prevents air from flowing therethrough while the material of nose brim 15 inhibits or prevents air from flowing therethrough. As illustrated in FIG. 2, nose brim 15 extends outward at an angle from the band 11 to form a funnel shaped atmospheric vent passage 30 or air pocket around an upper portion of the frontal opening 27 to permit the venting of exhaled air, first through the frontal opening 27 and then through the atmospheric vent passage 30, which enables one to direct exhaled air away from the user's face and thereby inhibit the fogging of a user's eyeglasses. Similarly, since the exhaled air does not contact the band proximate the users lips and nose, the clammy feeling occurring when moisture is trapped in the fabric of the headwear is minimized or eliminated.

FIG. 2 and FIG. 3 show the headwear 10 can be secured around a users'face by a drawstring 20 which extends in a channel 25 formed by a folded over top edge 14 that contains drawstring 20 and a clamp or stop 21 that can be secured to the drawstring to maintain the drawstring in a taut condition.

Figure 3A:
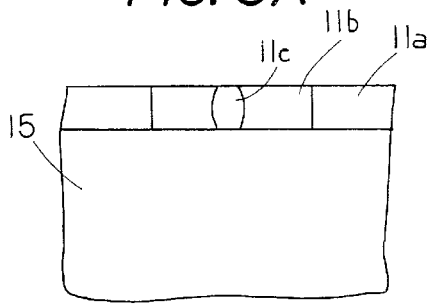
FIG. 3*a* is a sectional view taken along lines 3*a*—3*a* of FIG. 2.

FIG. 3A shows a separate second layer of material 11*b* that is located around the area of my headwear that is in contact with the bridge of a user's nose. In order to have the headgear conform to the user's nose I include a relief opening 11*c* in the portion of material which extends across the bride of the user's nose. This allows the material to fold tightly against the user nose to prevent air from escaping thereunder and fogging a user's glasses.

Figure 4:
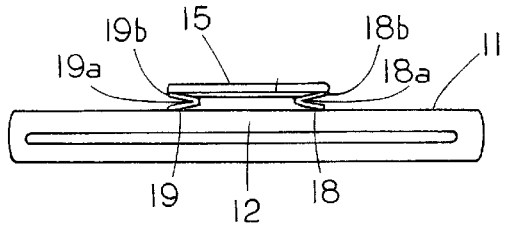
FIG. 4 is a bottom view showing how the nose brim lies flat in the neck gator mode or during storage.
Figure 4A:
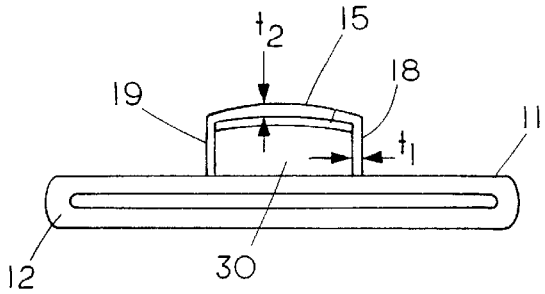
FIG. 4A is a bottom view showing the nose brim in an extended condition.

A reference to FIG. 4 illustrates how the nose brim 15 folds flat for blocking wind when the headwear is used in the neck gator or neck warmer mode. In the neck gator mode, the nose brim 15 is in a flat folding condition with the nose brim edges 19*b* and 18*b*, which are stitched to the adjacent pleats along an edge of the respective pleats, are located laterally outward of pleat 19*c* and 16*c*. The edge 18*a* of pleat 18, is stitched to band 11 and the edge 19*a* is also stitched to band 11. By allowing the pleats to lay in a parallel condition to the nose brim 15, when in a folded condition, it provides a dual benefit. First, it blocks the wind when my headwear is pulled down to use as a neck warmer. Second, it permits the nose brim 15 to lie flat for storage and shipping. On the other hand, when the user the head wear 10 in the face mask mode the nose brim 15 extends outward by the nose with the nose brim in the extended condition as shown in FIG. 4A. In this condition, the nose brim 15 forms the vent passageway 30 for discharging air away from the user's face.

Thus, in the present invention each of the tapered pleats 18 and 19 have an outer edge secured to an outer lateral edge of the nose brim 10 and an inner edge secured to the band 11 at a position inwardly of the outer lateral edges of the nose brim 10 to allow the nose brim 10 to lay flat when not in use and to expand outward to from a pocket or passageway 30 that directs moisture laden air away from the band 11 or nose brim 15 when the gator 10 is on a user's face. Generally, the pleats have a thickness It which is less than the thickness $t_2$ of the nose brim 15 to allow for more compact folding of the nose brim 15 against band 11. In the embodiment shown the pleats 18*a* and 18*b* are prepressed so as to return to the folded condition as shown in FIG. 4 when a user's nose is not in supporting engagement with the nose brim 15. This ensures that when headgear 10 is used in the neck warmer mode there will be no exposed passageway for air to enter. As can be seen in FIG. 1 the nose brim 15 extends sufficiently far as to cover the opening 27.

Figure 5:
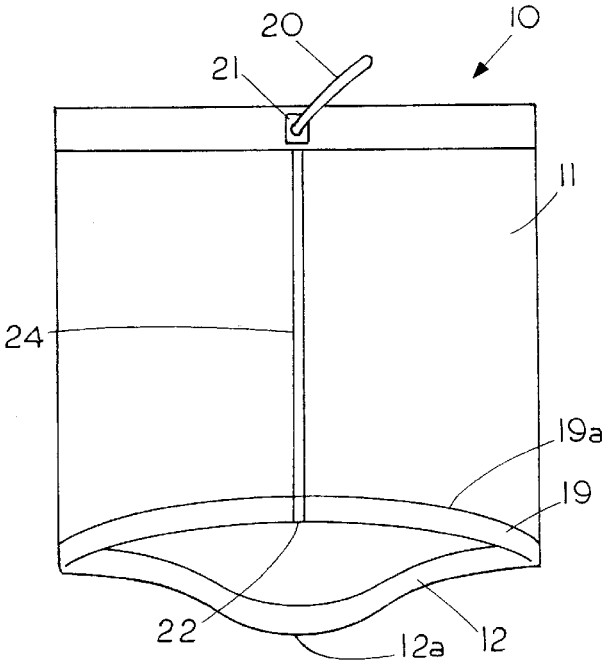
FIG. 5 is a rear view of the headwear of FIG. 1.

FIG. 5 shows a rear view of the headwear 10 illustrating that the bottom edge 12 has a nape relief 22 that extends upward and is circumferentially positioned on a rear portion of the stretchable band 11 to fit comfortably around the nape of a users neck. Headwear can also be provided with a frontal lip 12*a* for covering a frontal portion of a user's neck. In the embodiment shown the band 11 is made from a cloth material and is sewn together along a longitudinal seam by use of stitching 24 or the like.

Figure 6:
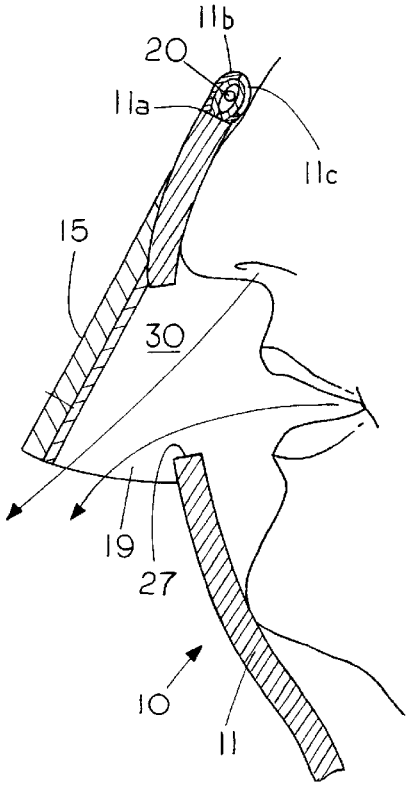
FIG. 6 is a partial sectional view with the headwear on a user including the passageway for exhaling air from the user through the mask.

FIG. 6 shows in section, headwear 10 located around a user'nares and mouth. In operation, the drawstring 20 secures the headwear 10 about the user's face and head. In the operable condition the top of nose brim contains layer 11*a* and layer 11*b* which are held in position by the drawstring 20. The relief opening 11*c* is proximate the bridge of the user's nose to allow the material to fold at the junction so as to follow the sides of the user's nose. In the face mask mode, as shown in FIG. 6, the nose brim 15 extends or angles outward and is held outward by the users nose. The angled nose brim 15 creates the vent passageway 30 or pocket in front of the frontal opening 27. The frontal opening 27 is sufficiently large so as not to cover or contact the user's nostrils or the users mouth thereby avoiding the clammy feeling that occurs when cloth material contacts the user mouth or nose. The arrows show that a person can exhale from either the users nose or mouth through an atmospheric vent passage 30 formed proximate the frontal opening 27 to permit the venting of exhaled air away from the user's face to thereby inhibit the fogging of a user's eyeglasses as well as to inhibit the feeling of clamminess occurring when moisture form the exhaled air is retained in the material.

FIG. 6 shows that the band 11 in conjunction with the frontal opening 27 is sufficiently large so as to leave a users lips and nostrils free of the band 11 and thus avoid the maintenance of the band proximate the users mouth and nostrils which can provide a clammy feeling to the face mask.

In order to ensure that the warm moisture laden exhaled air does not flow upward toward the users eyes the pleats 18 and 19 can be formed with wind-block material such as ripstop nylon to prevent passage of moisture laden air therethrough. As a consequence, if the nose brim 15 is made of material that prevents moisture from passing therethrough moisture laden air does not flow through either the nose brim 15 or the pleats 18 and 19 but discharges out the end of the nose brim 15, which is spaced way from the user face and the user's eyeglasses, thereby inhibiting the opportunity for the warm moisture laden air to contact a user's eyeglasses and fog the eyeglasses.

While the invention is usable in a neck gator or face protector mode a hood could be attached to the gator to provide full head cover. In addition, to conform the top edge to the user's face a material, such as foam or bendable material can be inserted in channel 25 to allow the face mask to better follow the contour of a user's nose.

I claim:

1. A convertible headwear for inhibiting fogging of a wearer's eyeglasses in a face mask mode and for use in two or more modes comprising:

a stretchable band, said stretchable band having a top and a bottom;

a face securement member;

a frontal opening, said frontal opening forming a vent for an exhaled breadth from either a user's nares or a user's mouth;

a nose brim, said nose brim secured to said stretchable band at a position above said frontal opening;

a first tapered pleat extending along a first side of said nose brim, said tapered pleat securing said first side of said nose brim to said stretchable band lateral of a first side of said frontal opening;

a second tapered pleat extending along a second side of said nose brim, said second tapered pleat securing said second side of said nose brim to said stretchable band lateral of a second side of said frontal opening, said first tapered pleat and said second tapered pleat and said nose brim comprising a wind-block material to allow said nose brim to extend outward to form an atmospheric vent passage from the frontal opening to permit the venting of exhaled air through the opening and the atmospheric vent passage to thereby direct the exhaled air away from the user's face to thereby inhibit the fogging of a user's eyeglasses, said first tapered pleat and said second tapered pleat foldable flat on the headwear to provide the headwear usable in the neck gator mode.

2. The convertible headwear of claim 1 wherein the frontal opening extends around a users nasal passages.

3. The convertible headwear of claim 1 wherein a peripheral edge of the frontal opening extends in a non-contacting relation to a users lips.

4. The convertible headwear of claim 1 wherein the frontal opening extends outwardly of both a users nasal passages and a users lips.

5. The convertible headwear of claim 1 wherein the pleats and the nose brim comprises ripstop nylon.

6. The convertible headwear of claim 1 wherein the band includes a channel extending around said top; and a drawstring located in said channel for securing the top of said band around a user's face and above a user's nose.

7. The convertible headwear of claim 1 wherein each of the tapered pleats have an outer edge are secured to an outer lateral edge of the nose brim and an inner edge secured to the band at a position inwardly of the outer lateral edges of the nose brim to allow the nose brim to lay flat when not in use and to expand outward to from a pocket when on a user's face.

8. The convertible headwear of claim 1 wherein the nose brim extends outward from the band to direct an exhaled breathe away from a user's eyeglasses to thereby inhibit the fogging thereof.

9. The convertible headwear of claim 1 including a frontal lip located on the bottom of said stretchable band for covering a frontal portion of a user's neck; and a nape relief located on the bottom of said stretchable band, said nape relief circumferentially positioned on a rear portion of said stretchable band.

10. A convertible headwear usable in multiple modes comprising:

a stretchable band for encircling a users neck and a portion of a user's face when used in a face mask mode;

a frontal opening in said band, said frontal opening sufficiently large to provide an unimpeded air flow path from an exhaled breath from either a users nares or a users mouth; and a nose brim;

a first pleat and a second pleat wherein each of the pleats has an outer edge secured to an edge of the nose brim and an inner edge secured to the headwear at a position laterally inward of the outer edge of the nose brim to permit the nose brim to lay flat when not in use, said nose brim extending outward from said band to form a chamber to contain a pocket of warm air proximate said frontal opening so that a person either inhales or exhales through the pocket of warm air proximate said frontal opening to thereby inhibit the fogging of a user's eyeglasses, said stretchable band usable in a neck warmer mode with said nose brim foldable to a closed condition to inhibit the ingress of air therethrough when the headwear is used in the neck warmer mode.

11. The headwear of claim 10 wherein the nose brim comprises a wind stop material.

12. The headwear of claim 10 wherein a first wind stop pleat extends along one side of said nose brim and a second wind stop pleat extends along an opposite side of said nose brim.

13. The headwear of claim 10 wherein the headwear includes a nape relief.

14. The headwear of claim 10 wherein the headwear includes a frontal lip for covering a front portion of a user's neck.

15. The headwear of claim 10 wherein the headwear includes a peripheral channel along a top portion with a drawstring located in said peripheral channel.

16. The headwear of claim 10 wherein each of the pleats have a triangular shape.

17. The headwear of claim 10 wherein frontal opening in the band is sufficiently large so as to leave a users lips free of the band.

18. The headwear of claim 10 wherein the frontal opening in the band is sufficiently large so as to leave the users lower nasal area free of the band.

19. The headwear of claim 10 including a double layer along a top edge of the headwear to provide closure around a user's nose to prevent air from escaping therepast.

* * * * *